United States Patent [19]

Larson

[11] Patent Number: 5,069,446

[45] Date of Patent: Dec. 3, 1991

[54] PHYSICAL REHABILITATION DEVICE AND METHOD

[76] Inventor: Roger R. Larson, 201 South Fourth St., Wilmington, N.C. 28401

[21] Appl. No.: 658,057

[22] Filed: Feb. 20, 1991

[51] Int. Cl.[5] ..... A63B 23/04

[52] U.S. Cl. ..... 272/96; 272/70; 128/25 B

[58] Field of Search ..... 128/25 R, 25 B; 272/96, 272/70

[56] References Cited

U.S. PATENT DOCUMENTS

| | | | |
|---|---|---|---|
| 1,546,506 | 7/1925 | Naysmith | 128/25 B |
| 3,525,522 | 8/1970 | Piller | 272/96 |
| 4,270,749 | 6/1981 | Hebern | 272/96 |
| 4,561,649 | 12/1985 | Forsythe | 272/96 |
| 4,862,875 | 9/1989 | Heaton | 128/25 R |

*Primary Examiner*—Richard J. Apley
*Assistant Examiner*—Lynne A. Reichard
*Attorney, Agent, or Firm*—Steven J. Hultquist

[57] ABSTRACT

A rehabilitation device for simulating walking movement, including a base assembly mounting a foot support member in elevated relation to a walking surface on which the base assembly is reposed. The base assembly features a slotted platform member which is interdigitatingly matable with a slotted anterior portion of the foot support member. The foot support member is pivotally translatable about a transverse axis between its anterior and posterior portions, such that the anterior end of the foot support member can swing below or above the platform member of the base assembly. The supported foot thus is able to "follow" the unsupported foot when the latter is moved forwardly or backwardly, and mimic natural walking movements. A corresponding rehabilitative method is disclosed. The invention is usefully employed to rehabilitate persons afflicted with stroke, muscular atrophy, etc.

11 Claims, 3 Drawing Sheets

PHYSICAL REHABILITATION DEVICE AND METHOD

BACKGROUND OF THE INVENTION

1. Field of the Invention

This invention relates to a rehabilitative device for simulating normal walking movement, and to a corresponding method of rehabilitation.

2. Description of the Related Art

Many physical incidents, such as stroke, phlebitis, muscular dystrophy, or injuries and ailments requiring extended bed rest, result in ambulatory deficits which must be redressed by physical therapy and rehabilitation.

In a number of such cases, one of the individual's lower extremities may be substantially weaker, less flexible, or more atrophied than the other. An example is a stroke affecting one side of the individual's body. In these instances, rehabilitative treatment is directed to strengthening and mobilizing the afflicted leg and/or foot.

Typically, the treatment of the afflicted lower extremity involves methods such as: walking between parallel support rails positioned at elbow or waist level while supporting one's weight manually on the rails; walking with a "walker" device (e.g., a four-legged support assembly which is manually advanced and leaned on by the individual during the walking process); or walking while being supported by a physical therapist, or other helper.

Each of these treatment means and methods has associated deficiencies which render them less than desirable for achieving the requisite strengthening and normalizing of the lower extremity.

When utilizing a parallel rail system or a walker device, or walking with the aid of a therapist or helper, the patient frequently has a tendency to move the weak leg by raising the hip and swinging the leg outwardly and forwardly without bending the knee, and to drop the foot without bending or flexing it. These tendencies are inimical to strengthening the leg and foot and restoring proper motive ability.

In addition, the parallel rail system is generally large in size, and is well suited for hospital or physical therapy center usage, but has little utility for home or outpatient use. Further, walker devices are often clumsy and difficult to effectively manipulate. Finally, walking with a physical therapist or other helper is also frequently clumsy, particularly when the patient is physically mismatched with the individual rendering assistance.

For all these reasons, it would be a significant advance in the art to provide a rehabilitative device and method for lower extremity treatment which is simple in construction, readily deployed, and highly efficient in simulating normal walking movement, for the purpose of strengthening and imparting increased mobility to a relatively weak or otherwise impaired lower extremity.

It is therefore an object of the present invention to provide a rehabilitative device and method of such type.

Other objects and advantages of the present invention will be more fully apparent from the ensuing disclosure and appended claims.

SUMMARY OF THE INVENTION

The present invention relates broadly to a rehabilitative means and method for simulating walking movement.

In one apparatus aspect, the invention relates to a rehabilitation device, comprising:

a base assembly reposable on a walking surface, comprising a generally planar platform member in elevated and generally parallel relationship to the walking surface, having a slotted rear portion defining slots each transversely bounded by rear portion fingers of the platform member; and a foot support member having a generally planar top surface, with anterior and posterior support portions for supporting the portions of a foot anterior and posterior to the ball of a foot, respectively.

In this apparatus, the anterior support portion of the foot support member is suitably slotted in character, with slots each transversely bounded by anterior fingers of the foot support member. The foot support member is mounted:

(i) on the base in elevated relationship to the walking surface;

(ii) with the slotted anterior support portion of the foot support member being interdigitated with the slotted platform member; and (iii) along a transverse axis between the anterior and posterior portions of the foot support member about the axis, between (a) a first position at which the anterior end of the foot support member is at a lowest elevation below the platform member, and (b) a second position at which the foot support member is at a highest elevation above the platform member.

Preferably, in each of the first and second positions, the included angle between the anterior portion of the foot support member and the platform member, is less than 90 degrees, and most preferably each such included angle is less than 45 degrees.

In a preferred aspect, the base assembly may comprise a generally horizontal base member for reposing the base assembly on the walking surface, and a vertical wall member joined at a lower extremity thereof to the base member and joined at an upper extremity thereof to the platform member forwardly of the slotted rear portion of the platform member.

In a particularly preferred aspect, the rehabilitative apparatus further comprise means for detachably securing the base assembly and foot support member thereto, together with a handle of inverted U-shape. The handle includes a horizontally aligned crossbar, and vertical sidebars each joined at an upper part thereof to the crossbar, and pivotally coupled at a lower part thereof to the frame, with one of the sidebars being secured to the foot support member for concurrent, i.e., integral and conjoint, pivotal movement therewith.

In a method aspect, the invention relates to a method of physically rehabilitating a patient by simulating walking movement, comprising:

providing a rehabilitation device of a type as described hereinabove;

positioning a patient with one of the patient's feet on the foot support member with the ball of the foot of the transverse axis of the foot support member, and with the other of the patient's feet in transversely spaced, and anterior or posterior relation to the foot supported on the foot support member; and sequentially and alternatingly translating the other one of the patient's feet anteriorly and posteriorly, opposite to its immediately prior position, while pivotally translating and flexing the foot supported on the foot support member to simulate a walking movement of the support foot.

Other aspects and features of the invention will be more fully apparent from the ensuing disclosure and appended claims.

DETAILED DESCRIPTION OF THE INVENTION, AND PREFERRED EMBODIMENTS THEREOF

The rehabilitative device and method of the present invention is based on the discovery that the rehabilitative process is promoted by providing an elevated structure on which the foot of the weak or impaired lower extremity of the patient is reposed, in which the structure serves to sequentially (1) forwardly flex the foot (to simulate the forward stepping movement of the foot in normal walking), (2) lower the heel of the foot to the underlying walking surface, e.g., floor, while simultaneously raising the anterior portion of the foot which is forward of the ball of the foot (to simulate the normal heel contact of the walking surface which begins a forward step), and (3) level the foot on the structure (to simulate the "lay-down" of the foot on the walking surface in normal walking, as the weight of the leg and the body is distributed onto the walking surface in mid-step).

Figure 1:
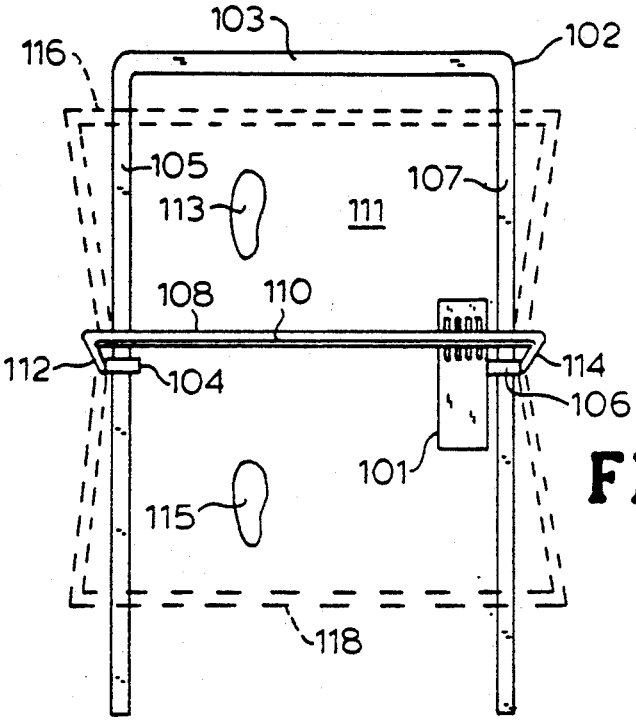
FIG. 1 is a top plan view of a rehabilitative device according to one embodiment of the invention.

Referring now to the drawings in FIGS. 1-6, in which the same parts are numbered correspondingly throughout, there is shown in FIG. 1 a top plan view of a rehabilitative device 100 according to one embodiment of the present invention.

The device 100 as illustrated in FIG. 1 comprises a frame 102 which is of inverted U-shape in the view shown, with a front crossbar 103 joined at its extremities to the sidebars 105 and 107. The frame may be of integral construction wherein the crossbars and sidebars are of unitary (single-piece) construction, or alternatively, the frame may be of segmented construction wherein the crossbar and sidebars are discrete structural elements which are mechanically fastened or otherwise joined to one another to form the frame 102. The frame may be formed of any suitable materials of construction having the requisite strength and rigidity, such as metals, wood, or structural plastics.

Mounted on each of the sidebars 105 and 107 at their intermediate portions are axles 104 and 106, respectively. As shown, these axles each extend inwardly from the respective sidebars toward one another, and are relatively short in length. It is also permissible in the broad practice of the invention to employ a unitary axle, shown in dotted line representation in FIG. 1 as element 109, which transversely extends between the respective crossbars, but this arrangement is much less preferred than the two-axle arrangement, since the unitary axle would occlude the otherwise unrestricted interior area 111 of the walking surface which is bounded by the crossbar and sidebars of the frame.

In the interior area 111 of the walking surface bounded by the frame, footprints 113 and 115 are schematically illustrated to denote the general location of the positions of the unimpaired foot (in this view the left foot of the individual using the device) during the therapeutic treatment, as will be described more fully hereinafter.

Mounted on the axle 106 is a base assembly/support unit 101, the structure and operation of which will be more fully described hereinafter with reference to FIGS. 2-6. The base assembly/support unit is provided to support and translate the foot of the impaired lower extremity so as to strengthen and restore motive ability to such extremity. This unit therefore is positioned on the right-hand axle 106 where the right leg is the extremity requiring therapy, and on the left-hand axle 104 when the left leg is the extremity in need of treatment. In the latter instance, of course, the footprints 113 and 115 would be positioned oppositely to their position as shown in FIG. 1.

In the event that a unitary axle 109 is employed with the frame, the base assembly/support unit 101 may be coupled thereto in such manner as to be transversely slidable thereon, so that the device may be alternatively used for the treatment of either the right leg or the left leg, depending on which is in need of rehabilitative therapy.

Coupled to the respective axles 104 and 106 is a handle 108. The handle is of inverted U-shape, comprising a horizontal crossbar 110, and sidebars 112 and 114 each having an upper extremity joined to the crossbar 110 and joined at its lower extremity to the respective axle. The handle may be integrally formed with the axles 104 and 106, or alternatively the handle may be secured to the axles by mechanical fasteners or coupled therewith in any other suitable manner. Regardless of the mode of interconnection, the handle is pivotally movable, conjointly with the rotation of the axles. In this manner, the movement of the handle to a forward position (shown by the dotted line representation 116 in FIG. 1) concurrently effects forward rotation of the axle 106 (as well as axle 104), so that the base assembly/support unit 101 is correspondingly actuated, as hereinafter described. Conversely, the movement of the handle 108 to a rearward position (shown by the dotted line representation 118 in FIG. 1) concurrently effects backward rotation of the axle 06 (as well as axle 104), so that the base assembly/support unit 101 is operated as hereinafter described.

The handle and base assembly/support unit shown in FIG. 1 may be formed of any suitable materials of construction, as for example those illustratively identified hereinabove.

Figure 2:
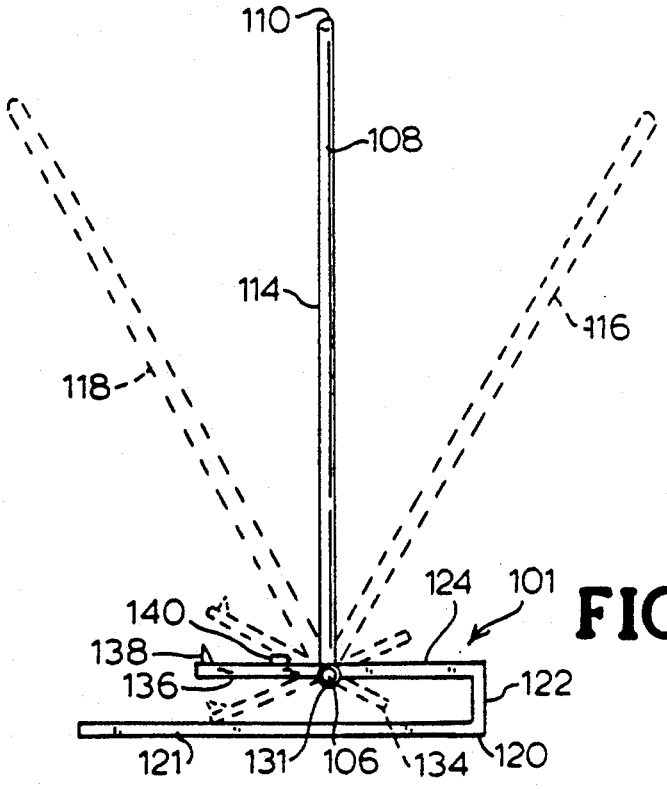
FIG. 2 is a side elevation view of the rehabilitative device of FIG. 1.

Referring now to FIG. 2, a side elevation view of the base assembly/support unit 101 and handle 108 is shown. The unit 101 comprises the base assembly 120 and the foot support member 130.

The base assembly 120 is arranged to mount on the axle 106 by means of a collar 131 into which the axle may be journaled or slidably reposed, the collar in turn being integrally secured to foot support member 130, so that the foot support member is rotatable about the axis of the axle 106 when the latter is rotated. For this purpose, collar 131 may be keyed or otherwise structured to mate cooperatively with the axle (structure not shown), so that rotation of the axle effects rotation of the foot support member. The collar 131 is also secured to the generally planar platform member 124 of the base assembly 120, but in a manner so that the platform member is not rotated or translated when the axle 106 is rotated; this may be accomplished by segmented collar arrangement shown in FIG. 4, described hereinafter.

In the base assembly, the platform member 124 is attached at its frontal end to the upper end of vertical wall member 122. This vertical wall member at its lower extremity is joined to the frontal or anterior end of the generally horizontal base member 121. In this manner a box-like structure is formed, open at its rear portion, and with the base member 121 being reposable on the floor, ground, or other walking surface.

Coupled to the axle 106 is the handle 108 (the crossbar 110 and sidebar 114 of which are shown in FIG. 2), whereby the handle, axle, and foot support member 130 are conjointly rotatable. FIG. 2 shows the foot support member in a horizontal position and the handle in a corresponding generally vertical position. In dotted line representation the handle and foot support member are shown with the handle in a forward position 116 (and the foot support member with its anterior portion 134 oriented forwardly and downwardly, and the anterior end reposed on the top surface of the base member 121, with the posterior end 136 extending upwardly above the plane of the platform member 124), and with the handle in a rearward position 118 (so that the anterior portion of the foot support member is above the plane of the platform member 124 and the posterior portion of the foot support member is below such plane). The foot support member is provided with a heel support 138 and a fastening strap 140, by means of which the foot of a user can be positioned and retained on the foot support member.

Figure 3:
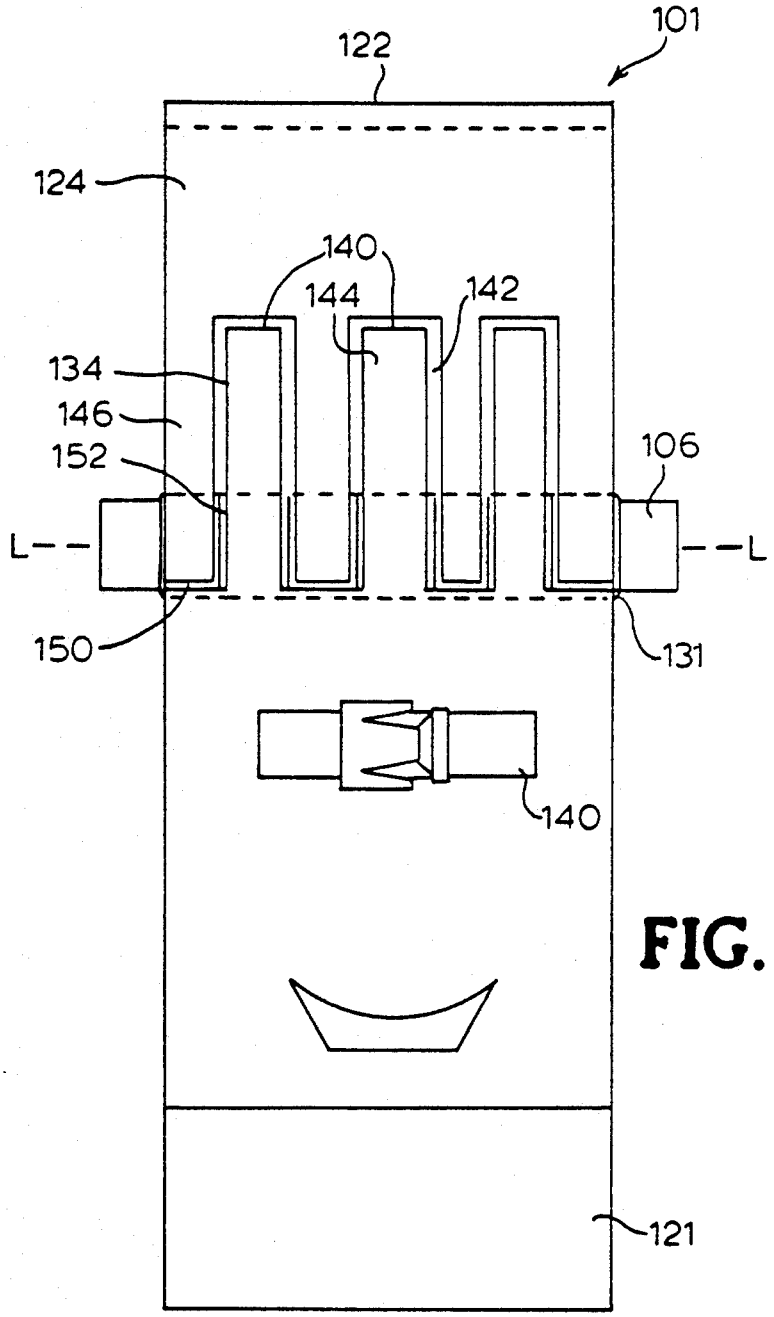
FIG. 3 is a top plan view of the base assembly and foot support member shown in FIG. 2.

FIG. 3 is a top plan view of the base assembly/support unit 101, showing the details of construction thereof.

The base assembly comprises the generally planar platform member 124 joined at its frontal extremity to the end wall 122 which in turn is joined to the base member 121.

The platform member 104 thus has a front portion and a rear portion in elevated and generally parallel relationship to the walking surface on which the base assembly is reposed. A plurality of slots 142 extends longitudinally through the platform from the rear portion forming a plurality of fingers 146 extending from the front portion of the platform member, with each of the fingers 146 being joined to a fixed collar segment 150 of collar 131. The axle 106 is reposed in fixed collar segments 150 so that the axle is freely rotatable against these segments (the axle being rotatable about axis L—L).

The foot support member 130 is integrally formed with collar segments 152, which alternate with the collar segments 150 of the platform member 124. Extending forwardly from the collar segments 152 are fingers 144 forming the anterior portion 134 of the foot support member. As mentioned, the collar segments can be secured to the axle by keying or other coupling structure (not shown), so that rotation of the axle 106 effects rotation of the collar segments 152 and the anterior portion 134 and posterior portion 136 of the foot support member, conjointly with the axle. The posterior portion of the foot support member features heel support 138 and fastenable strap 140 to properly position the foot on the foot support member.

Figure 4:
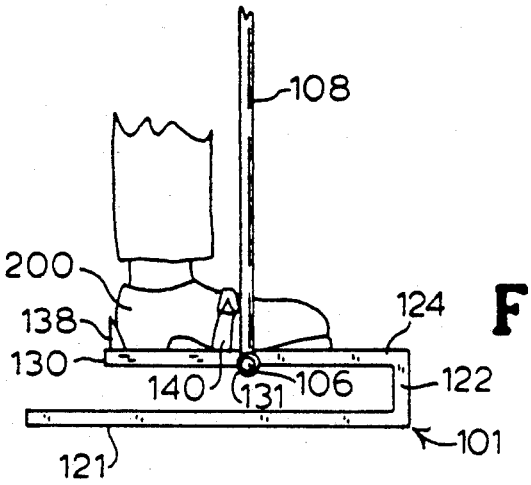
FIG. 4 is a side elevation view of the base assembly and foot support member of the FIG. 1 device.
Figure 5:
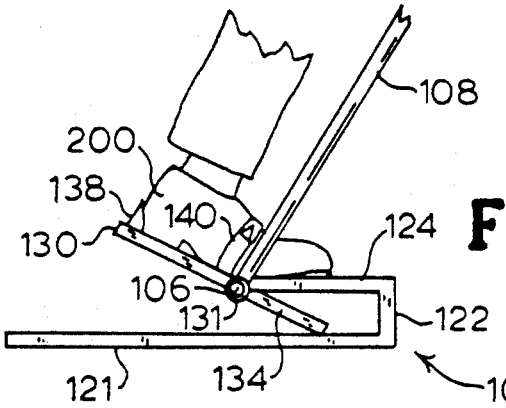
FIG. 5 is a side elevation view of the base assembly and foot support member of the FIG. 1 device, showing the foot of a user being forwardly flexed on the foot support member and the platform member of the base assembly.
Figure 6:
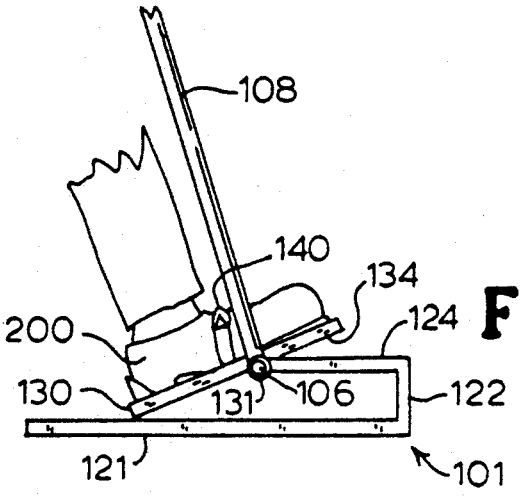
FIG. 6 is a side elevation view of the base assembly and foot support member of the FIG. 1 device, showing the foot of a user in the heel-down position on the foot support member.

The use and operation of the rehabilitative device of FIGS. 1-3 is shown in FIGS. 4-6.

FIG. 4 shows the foot 200 of a patient reposed on the base assembly/support unit 101, with the heel of the foot abutting the heel support, 138 and the foot being secured by the fastened strap 140 to the posterior portion of the foot support member 130, so that the ball of the foot is in proximity to axle 106 between the anterior and posterior portions of the foot support member. In the position illustrated, the foot support member is coplanarly aligned with the platform member 124 of the base assembly, and the foot is flat on the base assembly/support unit, in elevated relation to the walking surface on which the base member 121 is reposed. This is the position of the foot in mid-step, when the weight of the leg and body is distributed against the supportive surface. In this position, the handle 108 is generally vertical, and may suitably be manually grasped by the patient on the crossbar portion thereof (not shown in FIG. 4).

FIG. 5 shows the foot 200 of the patient in a forward stepping position, in which the handle 108 has been pushed forwardly by the patient. By this action, the axle 106 is rotated so that the foot support member is correspondingly pivotally rotated, with the anterior portion 134 of the foot support member being translated below the plane of the platform member 124 and the anterior or frontal edge 140 of the foot support member being in contact with the upper surface of the base member 121 of the base assembly. Correspondingly, the posterior portion 136 of the foot support member is translated above the plane of the platform member 124. Despite the lowering of the anterior portion of the foot support member below the platform member, the latter by virtue of its slotted construction provides a support surface on which the anterior portion of the foot is reposed, while the posterior portion of the foot continues to be supported by the posterior portion of the foot support member. Accordingly, the foot is flexed into a forward stepping position.

FIG. 6 shows the rehabilitative device with the foot positioned to simulate the heel-contacting action by which the heel of the foot contacts the walking surface at the beginning of a forward step. In this position, the handle 108 has been pulled backward by the patient, so that the anterior portion of the foot support member is above the platform member 124 and the posterior portion of the foot support member is below the plane of the platform member.

It is therefore seen that the rehabilitative device is highly effective in simulating the movement of walking for the foot supported by the foot support member, and that because the foot is supported in elevated relation to the walking surface by the foot support member and platform member, the knee of the patient using the device is caused to bend during the simulated walking process, so that the form of the entire leg movements during such process correspond to those of normal walking.

Referring again to FIG. 1 in connection with FIGS. 4, 5, and 6, the left foot may be positioned at footprint 115, with right foot supportively positioned on the base assembly/support unit in the position shown in FIG. 6. Subsequently, as the left foot is moved forwardly to footprint 113 and the handle 108 is pushed forwardly, the right foot assumes the intermediate position of FIG. 4, and as the left foot comes down fully on footprint 113 and the handle is pushed to its full forward position, the right foot assumes the position shown in FIG. 5. Thereafter, the movements can be reversed, so that by "walking backward" the initial starting position can be achieved, following which the "forward walking" movements can be repeated. In this manner, the weak or impaired extremity can be effectively exercised and strengthened in both directions of ambulation.

It will be recognized that the foregoing description in respect of a weak or impaired right lower extremity is for illustrative purposes, and that the apparatus and method may be oppositely practiced for rehabilitation of a left lower extremity (e.g., by oppositely positioning the base assembly/support unit on axle 104, and correspondingly relocating footprints 113 and 115).

It will also be recognized that while the preferred embodiment of the invention has been shown as comprising frame and handle elements, it may be feasible and desirable in some instances of the broad practice of the present invention to omit such elements, and to utilize only the base assembly/support unit with a discrete axle or corresponding coupling means interconnecting the interdigitated platform member and foot support member. Such unit may for example be usefully employed alone, when the patient is supported by a physical therapist or other assistance who holds the hand of the patient on the side of the unimpaired lower extremity and enables the patient to carry out the walking movements with only hand-holding support. Alternatively, the deficit of the impaired lower extremity may be sufficiently low that the patient is effectively rehabilitated without such assistance, using only the base assembly/support unit in an operatively configured arrangement of such unit.

Finally, while the invention has been shown and described herein with reference to preferred embodiments and features thereof, it will be appreciated that numerous alternative embodiments, features, modifications, and variations are to be regarded as being within the spirit and scope of the invention.

What is claimed is:

1. A rehabilitation device for simulating walking movement, comprising:

a base assembly adapted to repose on a walking surface, comprising a generally planar platform member having a front portion and a rear portion in elevated and generally parallel relationship to said walking surface, having a plurality of slots extending longitudinally through said platform from said rear portion forming a plurality of fingers extending from said front portion of said platform member; and a foot support member having a generally planar top surface, with anterior and posterior portions for supporting the portions of the foot anterior and posterior of the ball of the foot, respectively, said anterior portion having a plurality of slots extending through said foot support member from said anterior portion of said foot support member forming a plurality of fingers extending from said posterior portion of said foot support member, wherein said foot support member is rotatively mounted on said base such that said rear portion of said platform member is interdigitated with said anterior portion of said foot support member along an axis transverse to said platform member between said anterior and posterior portions of said foot support member, whereby said foot support member is rotated between a first position characterized by the anterior portion of said foot support member being at a lowest elevation with respect to said platform member, and a second position characterized by said anterior portion of said foot support member being at a highest elevation with respect to said platform member, with the included angle between said anterior member and said foot support member at said first position and the included angle between said anterior member and said foot support platform at said second position each being less than 90 degrees.

2. A device according to claim 1, wherein the base assembly comprises a generally horizontal base member for reposing the base assembly on the walking surface, a vertical wall member joined at a lower extremity thereof to the base member and joined at an upper extremity thereof to the platform member forwardly of the slotted rear portion of the platform member.

3. A device according to claim 1, further comprising a frame including means for detachably securing the base assembly and foot support member thereto.

4. A device according to claim 1, wherein the included angle between the anterior portion of the foot support member and the platform member at each of the first and second positions does not exceed about 45 degrees.

5. A device according to claim 1, wherein the included angle between the anterior portion of the foot support member and the platform member at each of the first and second positions does not exceed about 45 degrees.

6. A device according to claim 1, wherein a heel stop is disposed on the posterior portion of the foot support member, for positioning of a foot thereon.

7. A device according to claim 1, wherein means for securing a foot to the foot support member are disposed on the posterior portion of the foot support member.

8. A device according to claim 7, wherein the securing means comprise a foot strap assembly.

9. A device according to claim 3, wherein the frame is constructed and arranged so that the base assembly and foot support member are detachably securable at multiple positions on the frame.

10. A method of physically rehabilitating a patient by simulating walking movement, comprising:

providing a rehabilitation device for simulating walking movement, comprising:

a base assembly adapted to repose on a walking surface, comprising a generally planar platform member having a front portion and a rear portion in elevated and generally parallel relationship to said walking surface, having a plurality of slots extending longitudinally through said platform from said rear portion forming a plurality of fingers extending from said front portion of said platform member; and a foot support member having a generally planar top surface, with anterior and posterior portions for supporting the portions of the foot anterior and posterior of the ball of the foot, respectively, said anterior portion having a plurality of slots extending through said foot support member from said anterior portion of said foot support member forming a plurality of fingers extending from said posterior portion of said foot support member, wherein said foot support member is rotatively mounted on said base such that said rear portion of said platform member is interdigitated with said anterior portion of said foot support member along an axis transverse to said platform member between said anterior and posterior portions of said foot support member, whereby said foot support member is rotated between a first position characterized by the anterior portion of said foot support member being at a lowest elevation with respect to said platform member, and a second position characterized by said anterior portion of said foot support member being at a highest elevation with respect to said platform member, with the included angle between said anterior member and said foot support member at said first position and the included angle between said anterior member and said foot support platform at said second position each being less than 90 degrees;

positioning a patient with one of the patient's feet on the foot support member with the ball of the foot at the transverse axis thereof, and with the other one of the patient's feet in transversely spaced, and anterior or posterior, relation to the foot supported on the foot support member; and sequentially and alternatingly translating the other one of the patient's feet anteriorly and posteriorly, opposite to its immediately prior position, while pivotally translating and flexing the foot supported on the foot support member to simulate a walking movement of the supported foot.

11. A method according to claim 10, further comprising providing a manually grippable handle secured to the foot support member of the device, with the patient manually gripping the handle during the simulated walking movement.

* * * * *

UNITED STATES PATENT AND TRADEMARK OFFICE

CERTIFICATE OF CORRECTION

PATENT NO. : 5,069,446

DATED : December 3, 1991

INVENTOR(S) : Roger R. Larson

It is certified that error appears in the above-identified patent and that said Letters Patent is hereby corrected as shown below:

Column 4, line 60, change "06" to --106--.

Signed and Sealed this

Thirtieth Day of March, 1993

*Attest:*

STEPHEN G. KUNIN

*Attesting Officer*

*Acting Commissioner of Patents and Trademarks*